US006031496A

United States Patent [19]

Kuittinen et al.

[11] Patent Number: 6,031,496

[45] Date of Patent: Feb. 29, 2000

[54] COMBINATION ANTENNA

[75] Inventors: Tero Kuittinen; Petteri Annamaa, both of Oulu, Finland

[73] Assignee: IK-Products Oy, Kempele, Finland

[21] Appl. No.: 08/907,297

[22] Filed: Aug. 6, 1997

[30] Foreign Application Priority Data

Aug. 6, 1996 [FI] Finland ..... 963097

[51] Int. Cl.[7] ..... H01Q 1/24

[52] U.S. Cl. ..... 343/702; 343/895; 343/725; 343/729

[58] Field of Search ..... 343/702, 906, 343/895, 725, 729, 726, 730, 727; H01Q 1/24

[56] References Cited

U.S. PATENT DOCUMENTS

| | | | |
|---|---|---|---|
| 4,313,119 | 1/1982 | Garay et al. . | |
| 5,412,392 | 5/1995 | Tsunekawa . | |
| 5,760,745 | 6/1998 | Endo et al. | 343/702 |
| 5,844,525 | 12/1998 | Hayes et al. | 343/702 |
| 5,892,483 | 4/1999 | Hayes et al. | 343/702 |

FOREIGN PATENT DOCUMENTS

| | | | |
|---|---|---|---|
| 9023561 | 5/1990 | Finland | H01Q 1/24 |
| 2 280 789 | 2/1995 | United Kingdom | H01Q 1/38 |

*Primary Examiner*—Hoanganh Le
*Attorney, Agent, or Firm*—Darby & Darby

[57] ABSTRACT

A combination antenna has two antenna parts (8; 9, 9*a*, 17) and a connector part (10) to connect them to a radio apparatus. The first antenna part is a whip antenna and the second antenna part comprises a planar surface and a conductive pattern (16) formed on it to transmit and receive radio-frequency radiation. When the antenna parts are mechanically coupled to the connector part the plane surface, which includes a radiating conductive pattern, is separated from said first antenna part. In addition, the second antenna part or another part of the construction may include a plane surface with a plating on it, which in the normal operating position protects the user's head from radiation.

12 Claims, 7 Drawing Sheets

COMBINATION ANTENNA

BACKGROUND OF THE INVENTION

The invention relates in general to radio-frequency antennas and in particular to antenna constructions that include several radiating elements which can be taken into use through actions by the user. In addition, the invention is directed to decreasing that portion of the energy radiated by the antenna which is absorbed by the user of the radio apparatus.

Many kinds of requirements are set on the antennas of portable radio apparatuses. The antenna construction should be small and compact. Advantageously, it should include a movable part which, when pulled out, enhances the operation of the antenna compared to the position where the movable part is in the transport position, ie. pushed in. To enable the antenna construction to transmit and receive radiofrequency radiation in the latter position, too, and to prevent the transmission signal from being reflected via the open antenna port back to the radio apparatus the construction must include a radiating element permanently connected to the antenna port of the radio apparatus. The components of the construction shall be suitable for large-scale mass production where the mechanical tolerances are determined on the basis of the desired operating frequency and bandwidth of the antenna. Lately, a lot of attention has also been paid to the fact that radio-frequency radiation from the antenna should be directed, as much as possible, away from the user of the portable radio apparatus so as not be absorbed by him.

In this patent application we will discuss a mobile or wireless telephone as an example of a portable radio apparatus. Typical known antenna constructions in these apparatuses meeting at least part of the aforementioned requirements include various combinations of helix and whip elements. The movable part of an antenna construction usually consists of a whip element, ie. a straight conductor, which can be pulled out along its longitudinal axis and pushed inside the body of the telephone. The helix element, or a cylindrical coil conductor, is connected either to the top end of the whip element, in which case it moves with the whip element, or to the body of the telephone, in which case the whip element may move through the helix element. Different ways to create an electric coupling between the antenna port of the radio apparatus and the antenna elements as well as from an antenna element to another are disclosed e.g. in the Finnish patent application no. 952742, "Kaksitoiminen antenni".

However, constructions according to the prior art prove problematic as the operating frequencies of portable radio apparatuses become higher and higher. New cellular radio systems, such as the personal communication network (PCN) and personal communication system (PCS) operate at 1.8 to 2 GHz, wherein the radiation wavelength is about 15 cm and a radiating antenna element dimensioned according to a quarter of the wavelength is only a few centimeters in length. To manufacture prior art helix elements in series production in such a manner that dimensional fluctuation will not significantly affect the electrical characteristics of the antennas sets strict requirements on the manufacturing process. Attempts to reduce radiation directed to the user have usually led to clumsy shield arrangements that have numerous parts and are relatively expensive to manufacture.

SUMMARY OF THE INVENTION

An object of this invention is to provide an antenna construction that meets the above requirements for the antenna of a portable radio apparatus. Another object of the invention is to provide an antenna construction which by means of a simple structural arrangement reduces radiation directed to the user of the radio apparatus. A further object of the invention is to provide an antenna construction as described above which can be easily dimensioned to different frequency ranges and which can be manufactured without significant problems being caused by mechanical tolerances.

The objects of the invention are achieved by an antenna construction which has a moving antenna element and a fixed antenna element, of which the latter can be shaped like a plane, rectangular prism or other three-dimensional body, which enables reducing the radiation load directed to the user's head by means of suitable positioning of the element and an electrically conductive layer formed on its surface. Achievement of the objects of the invention is also furthered by the fact that known, mechanically accurate and low-cost methods can be applied to the manufacture of planar antenna elements.

The combination antenna comprising a first antenna part and a second antenna part, said first antenna part being a straight conductor constituting a whip antenna, and a connector part to connect said first and second antenna parts to a radio apparatus is characterized in that said second antenna part comprises a first plane surface which further comprises a conductive pattern to transmit and receive radio-frequency radiation and while said first and second antenna parts are mechanically attached to said connector part said first plane surface is separated from said first antenna part.

The invention is based on the perception that it is advantageous to replace a fixed antenna element, which in known antenna constructions almost always comprises a cylindrical coil conductor, with a planar antenna element. There are several known techniques, both mechanically accurate and low in cost, to create planar conductive patterns. The framework for the conductive pattern comprises an electrically non-conductive substrate which may be e.g. an epoxide plastic sheet used as a base material for printed circuit boards, a low-loss substrate board known from highfrequency microstrip couplings, or a ceramic material known from dielectric radio frequency filters.

If the planar conductive pattern acting as an antenna element is created on one side of a board or a substrate shaped like a rectangular prism, metal plating or other suitable material can be used to create on the other side a ground plane which prevents the radio-frequency radiation emitted by the antenna element from propagating into that sector of space which is covered by the ground plane as viewed from the direction of the antenna element. Because of their construction mobile and wireless telephones have a certain operating position with respect to the user's head, so the antenna according to the invention can be installed in a phone so that in the normal operating position the ground plane of the planar antenna element prevents radiation transmitted by the antenna from being directed to the user's head. This is not possible in prior art antennas the constructions and radiation fields of which are essentially cylindrically symmetric.

A planar antenna element can also be positioned in the antenna construction in such a way that its longitudinal axis is not coincident with the centre axis of the cylindrically symmetric structure formed by the whip element and the antenna connector. A shift of a few millimetres from the centre axis of the antenna construction in a direction which, considering the normal operating position of the phone, is away from the user's head results in perceptible reduction in the radiation load directed to the user because the so-called SAR value describing the amount of radiation absorbed by the user decreases almost quadratically or exponentially as a function of the distance, and the distance between the antenna and the user's head is in any case only a few centimetres.

BRIEF DESCRIPTION OF THE DRAWINGS

The invention is described in greater detail with reference to the preferred embodiments, presented by way of example, and to the accompanying drawings, wherein FIG. 3*a* shows an embodiment of the antenna construction according to the invention where the whip element is pushed in, FIG. 4*a* shows another embodiment of the antenna construction according to the invention where the whip element is pushed in.

Like elements in the drawings are denoted by like reference designators.

DETAILED DESCRIPTION OF EXEMPLARY EMBODIMENTS

Figure 1A:
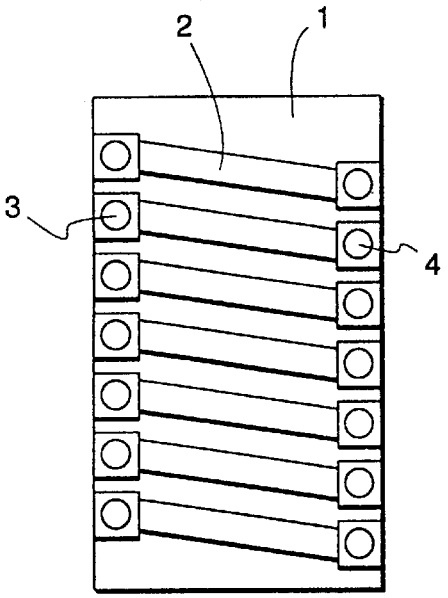
FIG. 1*a* shows a known planar antenna element.

As such, the planar antenna element is not a new invention. Patent document GB 2 280 789 discloses a planar helix antenna according to FIG. 1, wherein conductor strips 2 are formed on the surface of a printed circuit board 1. Said patent document discloses that the same kind of conductor strips can also be formed on the reverse side of the printed circuit board 1, in which case the conductor strips are interconnected by means of plated through holes 3, 4. The conductor strips are positioned diagonally so that through holes 3 and 4, which are located at the opposite ends of two adjacent conductor strips on that side of the printed circuit board 1 which is shown, are connected by one conductor strip on the reverse side of the printed circuit board. The construction thus created is like a long conductor wound into a fairly thin coil around the printed circuit board 1. The document also discloses an alternative embodiment which has conductor strips only on one side of a printed circuit board which is so flexible that it can be bent into a cylinder. Then, one end of each conductor strip extending diagonally across the printed circuit board can be connected to a second end of the adjacent conductor strip thereby creating a construction in which a continuous conductor makes several turns around a cylindrical substrate. Said document further discloses that instead of a printed circuit board the substrate may be of a ceramic material and that instead of oblong conductor strips the antenna may comprise conductive patches of various shapes.

Figure 1B:
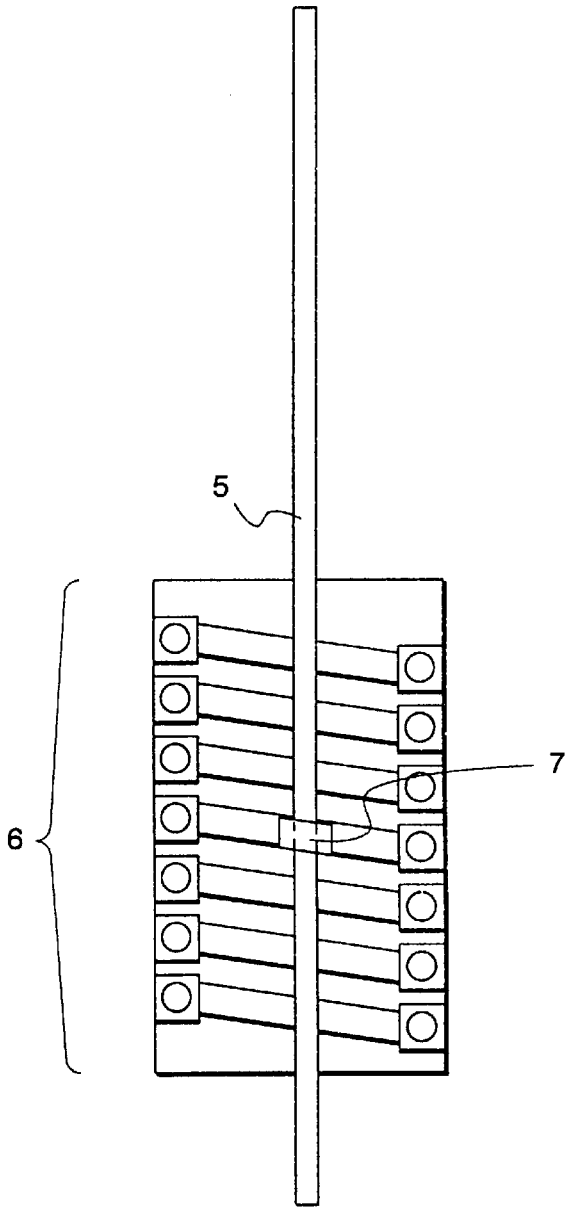
FIG. 1*b* shows a known method of connecting the antenna element of FIG. 1*a* to a movable whip antenna.

In addition, said patent document discloses an antenna construction according to FIG. 1*b* wherein the whip element 5 can be moved with respect to the planar antenna element 6 and wherein electric contact between the antenna elements is realized by means of a conductor ring 7. The document states that when pushed in, the whip element serves as a passive reflector that protects the user's head from radiation. However, the whip element, even when pushed in, cannot be grounded since it is always in electrically conductive connection with the planar antenna element.

Figure 2A:
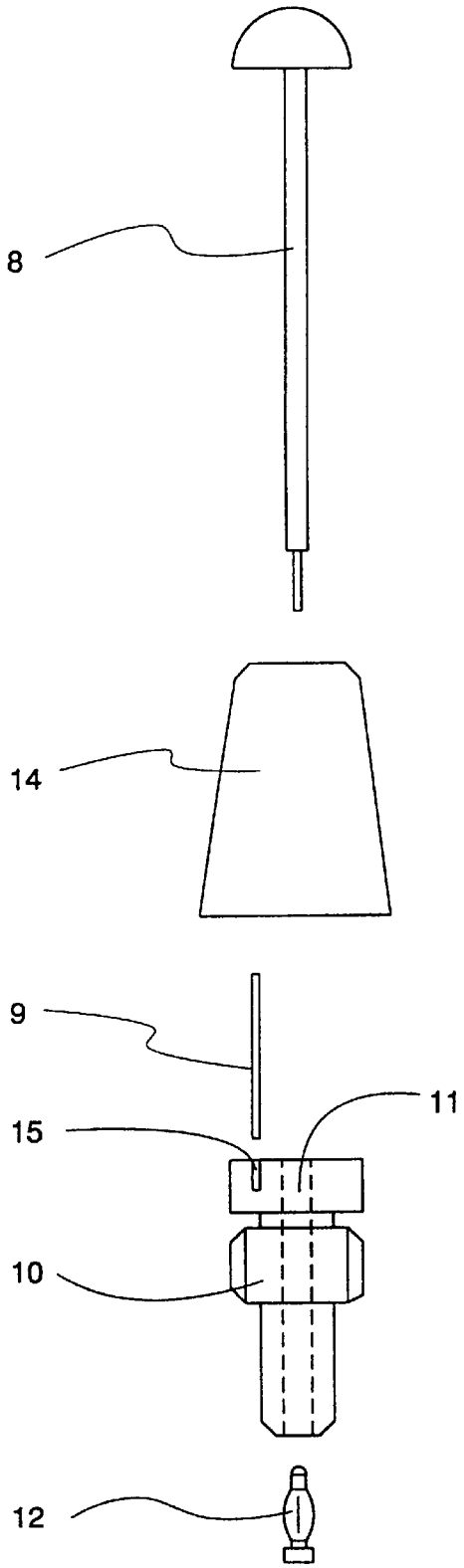
FIG. 2*a* is an exploded view of an embodiment of the antenna construction according to the invention.
Figure 2B:
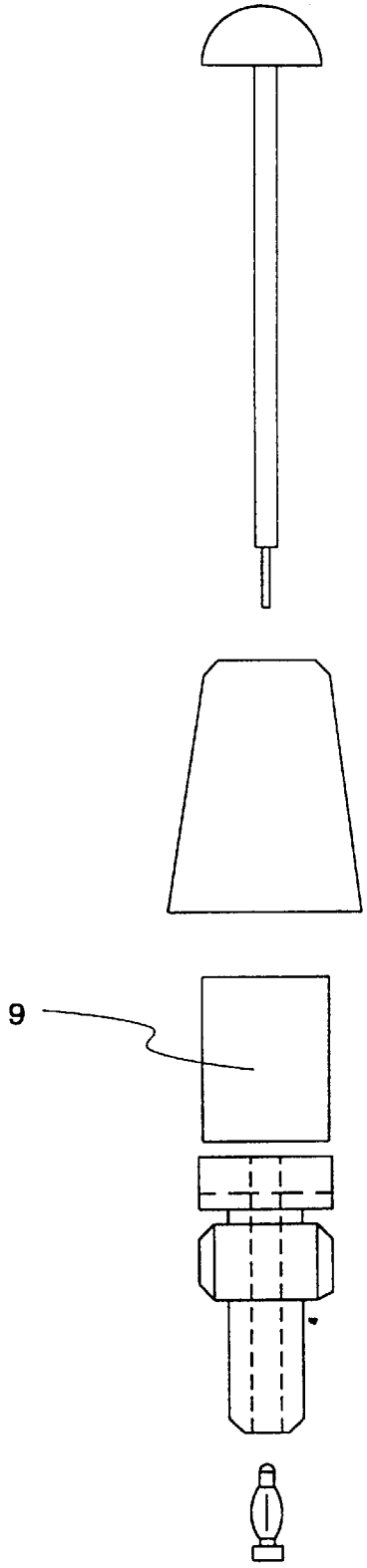
FIG. 2*b* shows the antenna construction of FIG. 2*a* viewed from another direction.

FIG. 2*a* is an exploded view of a preferred embodiment of the antenna construction according to the invention. The construction includes a whip antenna 8 and a planar antenna part 9. The latter of these is meant to be permanently attached to a connector part 10 the purpose of which is to electrically and mechanically connect the antenna construction to a radio apparatus (not shown). A hole 11 extends through the connector part 10 in a vertical direction with respect to the position shown. The whip antenna 8 and the hole 11 are so dimensioned that the whip antenna can be moved along its longitudinal axis when it is pushed via the hole through the connector part 10. A laminated bushing 12 is attached to the lower end of the whip antenna. A protective jacket 14 made of an insulating material, such as injection-moulded plastic, can be installed to shield the upper end of the connector part and the planar antenna part 9. The antenna construction shown in the drawing is assembled by pushing the whip antenna 8 downward, with respect to the position shown, so that it becomes attached to the laminated bushing 12, pushing the planar antenna part 9 downward, with respect to the position shown, so that it enters a slot 15 in the upper part of the connector part 10, and by pushing the protective jacket 14 downward, with respect to the position shown, so that it becomes attached to the upper end of the connector part. Gluing, soldering, melting, pressing or other methods known to a person skilled in the art can be used to strengthen the joints. FIG. 2*b* shows the same antenna construction viewed from the direction of the normal of the plane surface of the planar antenna part 9.

Figure 3A:
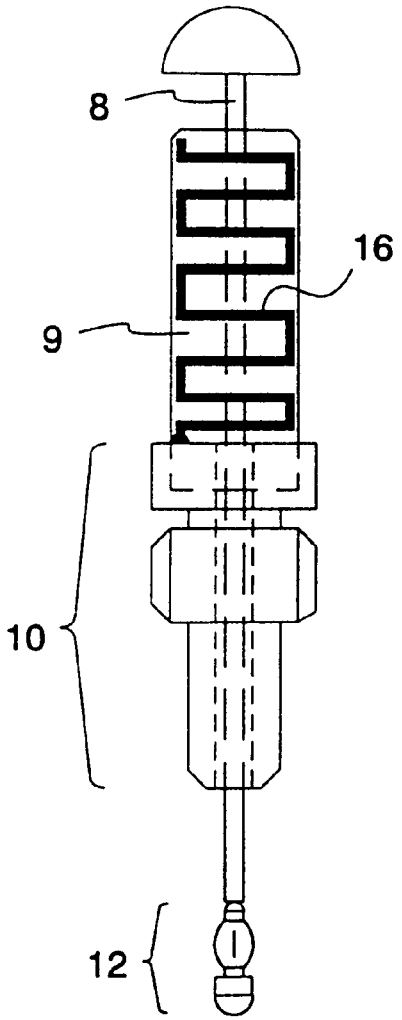
Figure 3B:
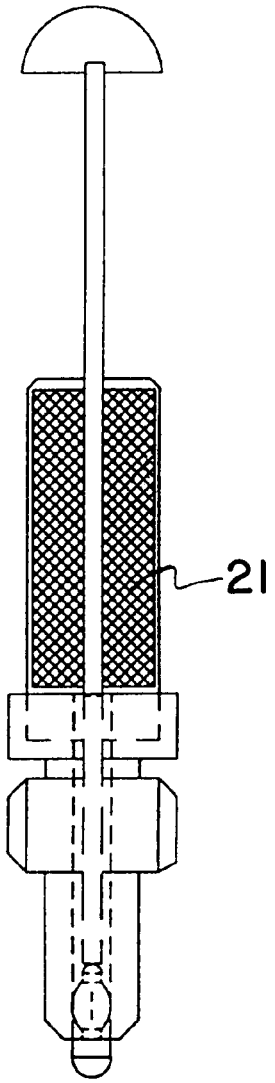
FIG. 3*b* shows the antenna construction of FIG. 3*a* with the whip element pulled out.

FIGS. 3*a* and 3*b* show assembled the above-described antenna construction according to a preferred embodiment. The laminated bushing 12 attached to the lower end of the whip antenna 8 has two functions. First, its diameter is at least in one location greater than that of the hole in the connector part, thereby preventing the user from pulling the whip antenna entirely through the connector part 10. Second, its outer surface is at least in one location electrically conductive so that an electric coupling is made between the lower end of the whip antenna and the connector part when the whip antenna is pulled out (FIG. 3*b*). In FIG. 3*a*, where the whip antenna is pushed in, the only radiating antenna element is the conductive pattern 16 formed on the surface of the planar antenna part 9 and connected at the lower end in an electrically conductive manner to the connector part 10. The shape of the pattern may be similar to the square waveform shown in the drawing or it may be similar to the shape of a known planar antenna pattern.

The amount of radiation absorbed by the user can be reduced by forming a continuous plating or other electrically conductive layer on that plane surface of the planar antenna part 9 which is on the opposite side to the pattern shown in FIG. 3*a*. In FIG. 3*b*, wherein the antenna construction is shown from the side opposite to the side shown in FIG. 3*a*, the plating 21 is marked by a crisscross pattern. Particularly in the situation depicted by FIG. 3*a*, wherein the whip antenna is pushed in and only the conductive pattern 16 emits radio-frequency radiation, the plating 21 on the reverse side of the planar antenna part effectively prevents radiation from being emitted to the direction which is inward from the paper surface, with respect to the position shown in the drawing. In a mobile phone or other radio apparatus meant to be used near the head the antenna construction is advantageously placed so that in the normal operating position of the apparatus the direction to which radiation is prevented from being emitted is approximately that from the antenna toward the centre of the user's head. The preventive effect is perceptible on quite a wide sector, so accurate directioning is not required. Since the planar antenna part is not located on the vertical centre axis of the antenna construction, it is also advantageous to place the antenna in the radio apparatus in such a manner that the direction to which the planar antenna part deviates from the centre axis of the construction, is, in the normal operating position of the apparatus, the same as the direction away from the user's head.

Figure 4A:
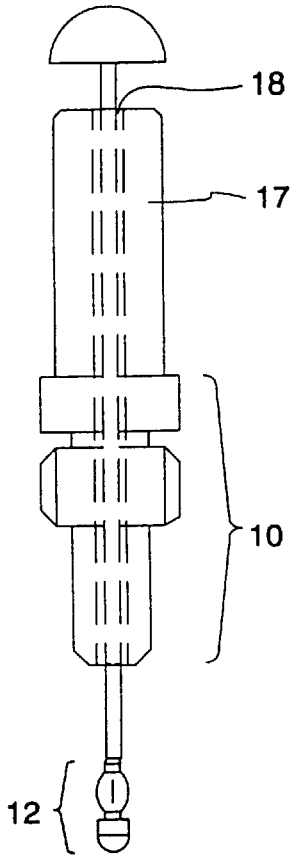
Figure 4B:
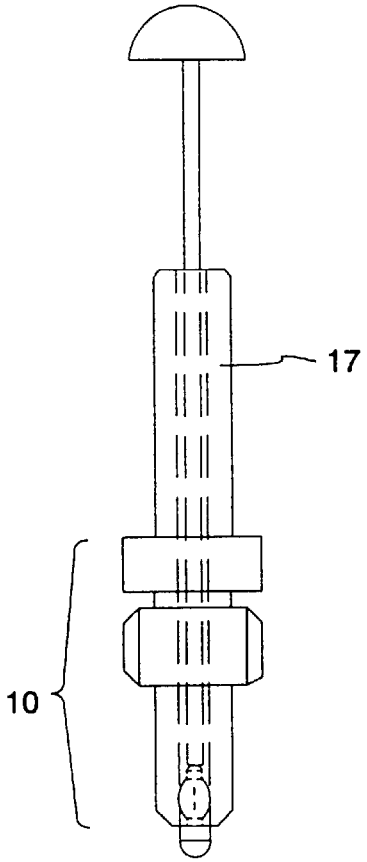
FIG. 4*b* shows the antenna construction of FIG. 4*a* with the whip element pulled out, viewed from another direction.
Figure 4C:
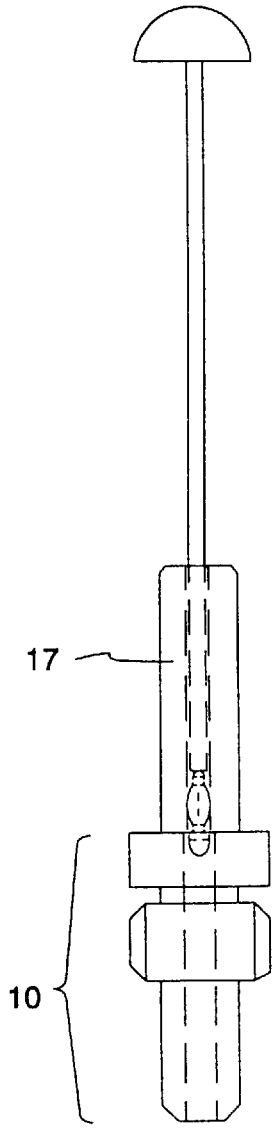
FIG. 4*c* shows a variation of the antenna construction of FIGS. 4*a* and 4*b*.

FIGS. 4*a*, 4*b* and 4*c* show another preferred embodiment of the antenna construction according to the invention. In that embodiment, the planar antenna part is replaced by an antenna part 17 shaped like a rectangular prism, made of a dielectric material and bounded by four side surfaces of which the opposite ones are parallel and the adjacent ones are perpendicular to each other, and by two end surfaces perpendicular to the side surfaces. The surfaces need not necessarily be perfectly planar, perpendicular or parallel, but the rectangular prism was chosen as the shape of the antenna part mainly because pieces shaped like rectangular prisms are simple to manufacture. FIG. 4*a*, in which the whip antenna 8 is pushed in, shows the antenna construction viewed from the direction of the normal of a side surface of the antenna part. In this case, the rectangular-prism-shaped antenna part 17 is attached to the connector part 10 in such a way that their longitudinal axes coincide. A hole 18 extends through the antenna part 17 parallel to its longitudinal axis, which hole, like the hole in the connector part, is so dimensioned that the whip antenna can be moved along its longitudinal axis. FIG. 4*b*, in which the whip antenna 8 is pulled out, shows the same antenna construction turned 90 degrees around its longitudinal axis, or viewed from the direction of another side surface of the antenna part 17.

For reasons of graphic clarity, FIGS. 4*a* through 4*c* do not show the conductive patterns on the surfaces of the antenna part 17. According to the invention, a conductive pattern is formed on the surface of the antenna part 17 which acts as a radiating antenna element when the whip antenna 8 is pushed in and there is no coupling between it and the connector part 10. The conductive pattern is electrically coupled with the connector part 10 and it may be shaped like the square wave shown in FIGS. 3*a* and 3*b* or like some other known planar antenna pattern. If the conductive pattern is formed only on one side surface of the antenna part 17, the amount of radiation absorbed by the user can again be reduced by creating a continuous plating or other electrically conductive layer on that side surface of the rectangular antenna part 17 which is on the opposite side to the conductive pattern. The antenna is located in the radio apparatus according to the same principle as above, ie. the radiating conductive pattern is placed, with respect to the normal operating position, as far away from the user's head as possible, whereby the reflecting plating is located suitably between the radiating conductive pattern and the user's head.

In the embodiment illustrated by FIGS. 4*a* through 4*c*, the laminated bushing 12 attached to the lower end of the whip antenna 8 can be dimensioned in two differing ways. In the first option, the laminated bushing and the lower end of the connector part 10 become electrically connected in the manner described above when the whip antenna is pulled out (FIG. 4*b*). In the second option, the laminated bushing can move through the hole in the connector part but catches a lug or a narrowing somewhere in the hole in the rectangular-prism-shaped antenna part 17. Then, a suitable plating or other electrically conductive area must be created on the inner surface of the hole in the antenna part 17 so as to make an electric coupling with the laminated bushing when the whip antenna is pulled out. FIG. 4*c* shows the latter option.

Figure 5:
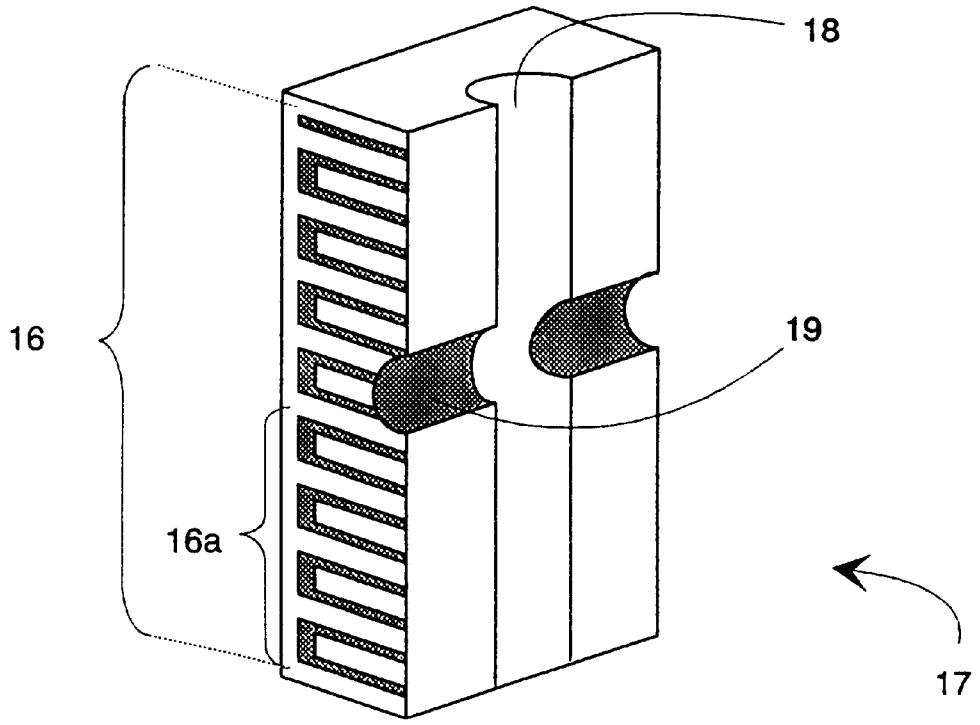
FIG. 5 is a cross-section of a dielectric body which can be used in a preferred embodiment of the invention.
Figure 5A:
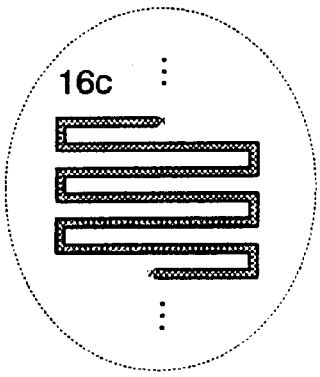
Figure 6:
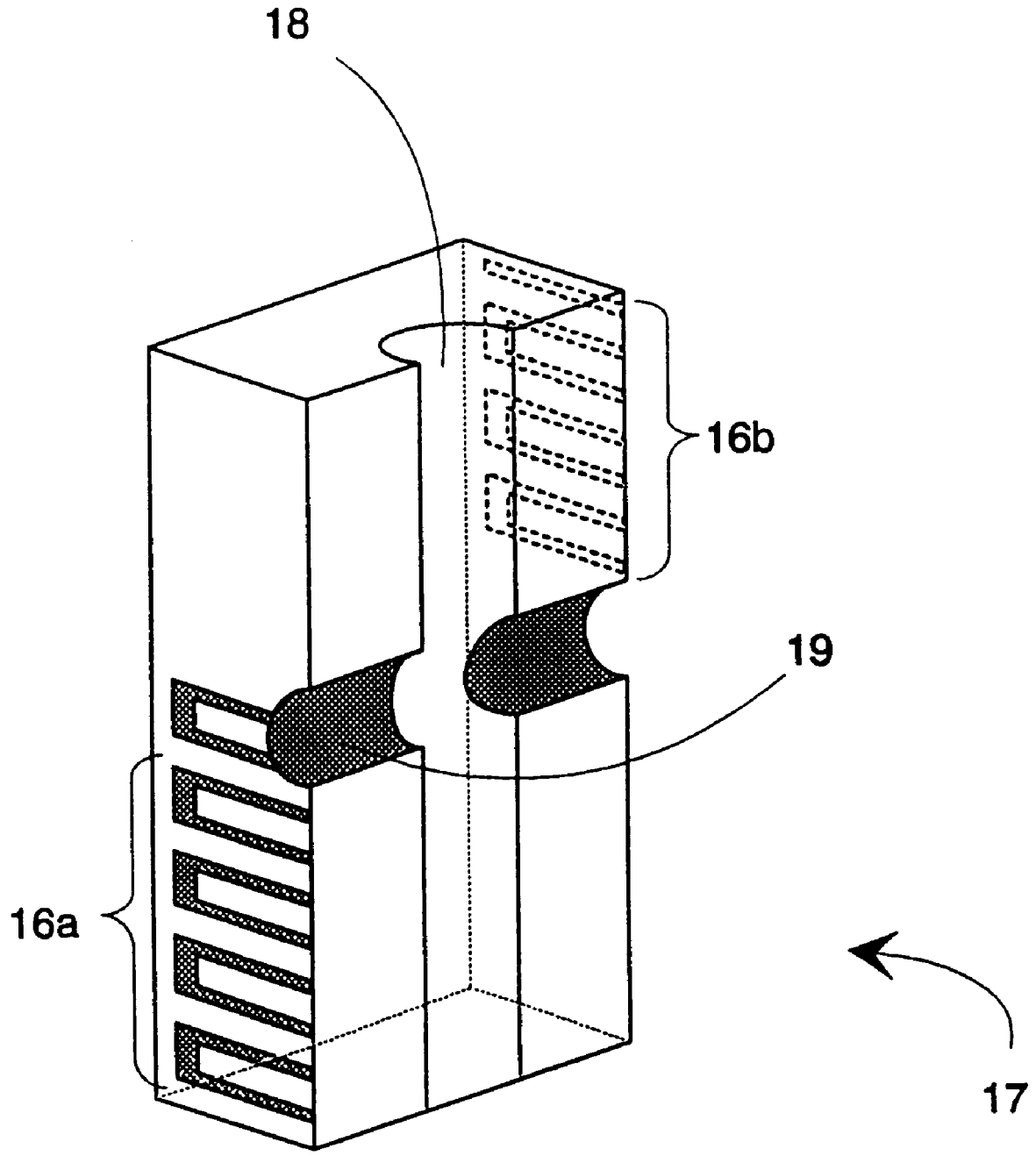
FIG. 6 is a cross-section of a second dielectric body which can be used in a preferred embodiment of the invention.

FIGS. 5 and 6 are axonometric cross-sections of two different rectangular-prism-shaped antenna parts that can be used in the preferred embodiments of the invention. In the antenna part of FIG. 5, the conductive pattern 16 is formed only on one surface of the antenna part 17. The conductive pattern is a continuous conductor according to illustration 16*c*, travelling in multiple square turns from one edge of the surface to the other but the cross-section naturally shows only half of it. In this case it is also desirable to use the lower part 16*a* of the conductive pattern as a so-called shortening coil for the whip antenna (not shown) in its extended position. To that end, the antenna part 17 has a through hole 19, which here is depicted as a hole extending through the entire piece. It may also extend from the surface containing the conductive pattern 16 to the inner surface of hole 18. The through hole 19 is metal-plated, and when the user pulls the whip antenna into a position in which the laminated bushing at the lower end of the whip antenna touches the end of the through hole on the inner surface of hole 18, the radiating antenna element comprises the lower part 16*a* of the conductive pattern, the plating of the through hole 19 and the whip antenna.

FIG. 6 shows a rectangular-prism-shaped antenna part otherwise identical to that of FIG. 5 except for that in this case the conductive pattern acting as a radiating antenna element is divided onto two opposite surfaces of the piece. The lower part 16*a* ends at the through hole 19 which is plated and extends to the opposite side of the piece. On the opposite side, the upper part 16*b* of the conductive pattern begins from the through hole 19 and extends towards the upper part of the piece. In the light of the facts presented above it is obvious to one skilled in the art that the conductive patterns can be located in various ways on different surfaces of the antenna part shaped as a rectangular prism. The pattern may extend from a surface to an adjacent surface around the edge of the piece without any through holes.

The fixed antenna part needed in the antenna construction according to the invention can be plate-like or shaped like a rectangular prism. However, the invention does not exclude other three-dimensional bodies that can serve as an antenna part. The antenna part belonging to the antenna construction according to the invention can be made using a printed circuit board, low-loss substrate used as a base material for microstrip couplings, dielectric ceramic material or other material known to a person skilled in the art. The creation of conductive patterns and platings on surfaces of pieces of this kind as well as the creation of holes and plated through holes are operations that are known to one skilled in the art. It is also possible to connect to the conductive patterns and/or pads formed on the surface of the antenna part separate components which can be used for impedance matching, filtering or signal amplification, for example.

Figure 7:
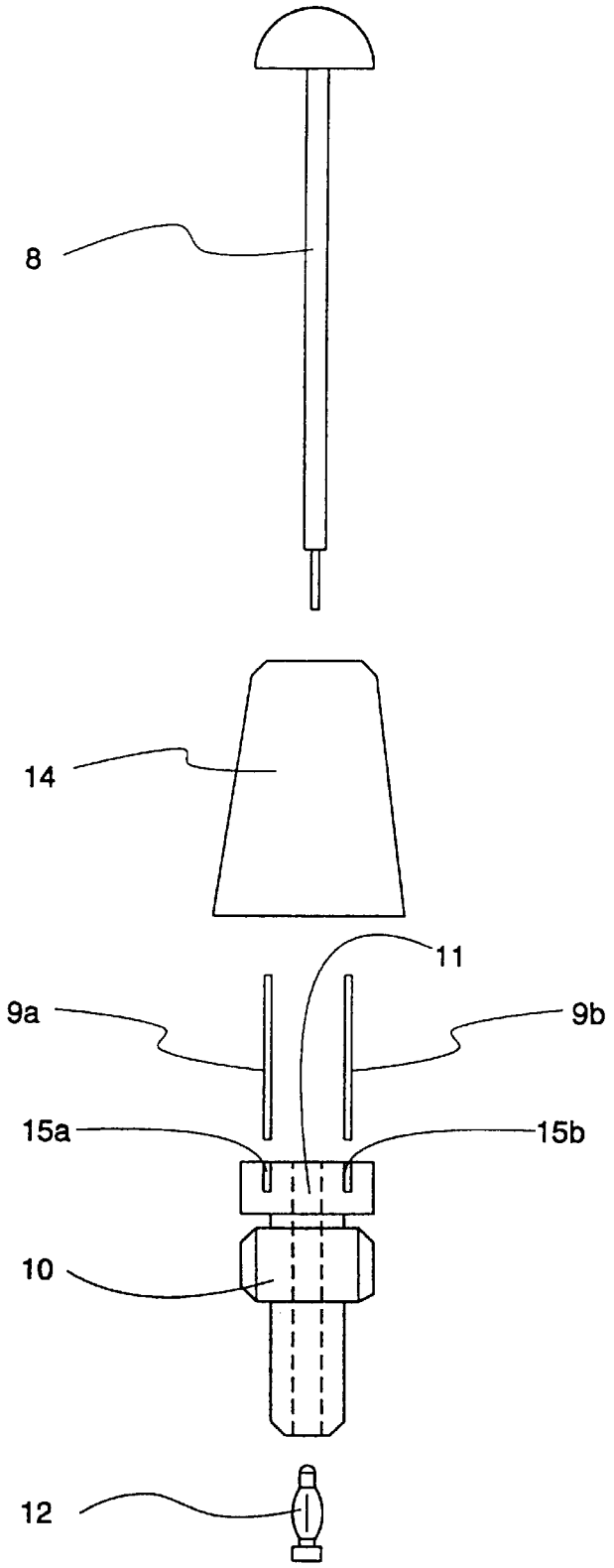
FIG. 7 shows a variation of the antenna construction of FIGS. 2*a* and 2*b*.

The antenna construction according to the invention may also comprise, in accordance with FIG. 7, two plate-like or rectangular-prism-shaped parts the first part 9*a* of which is an antenna part including a radiating conductive pattern (not shown) and the latter part 9*b* is a protective part including a shielding layer that is electrically conductive. In the embodiment shown, both have their own attachment slots 15*a* and 15*b* which can be parallel, as shown, or non-parallel, in which case the plane of the electrically conductive shield layer is not parallel to the plane of the radiating planar antenna element. However, placing the shield layer further away from the radiating conductor element will reduce the spatial sector covered by the shield layer, as viewed from the radiating conductor element, so it may reduce the user's radiation shield. Furthermore, regarding assembly, two separate plate-like parts is not as good a solution as one single part.

It is to be noted that an antenna part comprising e.g. a ceramic body block and a conductive pattern formed on it by means of litography or serigraphy can easily be manufactured with an accuracy of one hundreth of a millimetre, which is a considerable improvement as compared to a helix antenna twisted from metal wire. The antenna construction according to the invention is well suited for large-scale series production as its parts are simple and few in number and the assembly of the construction requires no manual work. By altering the dimensioning of various parts in a manner known to a person skilled in the art the construction can be made to operate in the desired frequency range. The shielding metal plating on one surface of the fixed antenna part protects the user from radiation.

We claim:

1. A combination antenna for radio frequency transmitting and receiving comprising:

a first antenna part (8) and a second antenna part (9, 9*a*, 17), said first antenna part being a straight conductor constituting a whip antenna, and;

a connector part (10) for connecting said first and second antenna parts to radio apparatus, characterized in that said second antenna part (9, 9*a*, 17) comprises a first plane surface which further comprises a conductive pattern (16) for transmitting an)d receiving radio-frequency radiation, a second plane surface which comprises an electrically conductive area (21), which is essentially as wide as said conductive pattern, for attenuating in a certain direction radio-frequency radiation emitted by said conductive pattern (16), while said first and second antenna mechanically contacted to said connector part, said first plane surface is separated from said first antenna part and said first antenna part is moveable with respect to said connector part and said second antenna part.

2. The combination antenna of claim 1, characterized in that said second plane surface is physically included in a different part (9*b*) than said first plane surface.

3. The combination antenna of claim 1, characterized in that said second plane surface is included in the second antenna part (9, 17).

4. The combination antenna of claim 3, characterized in that while said first (8) and second (9) antenna parts are mechanically coupled to said connector part, said second plane surface is between said first plane surface and said first antenna part.

5. The combination antenna of claim 3, characterized in that while said first (8) and second (17) antenna parts are mechanically contacted to said connector part, said first antenna part is between said first and second plane surfaces and extends through said second antenna part.

6. The combination antenna of claim 1, characterized in that said second antenna part comprises at least two plane surfaces and said conductive pattern is divided (16*a*, 16*b*) onto at least two plane surfaces.

7. The combination antenna of claim 1, characterized in that said second antenna part is made of a material which is one of the following: printed circuit board, lowloss substrate used as a substrate for microstrip couplings.

8. The combination antenna of claim 7, characterized in that said connector part is substantially cylindrically symmetric and while said first and second antenna parts are mechanically coupled to said connector part, the longitudinal axis of said first antenna part coincides with the longitudinal axis of said connector part and said second antenna part is located off the longitudinal axis of said connector part.

9. The combination antenna of claim 1, characterized in that said second antenna part is made of a dielectric ceramic material.

10. The combination antenna of claim 9, characterized in that said connector part is substantially cylindrically symmetric and while said first and second antenna parts are mechanically coupled to said connector part, their longitudinal axes coincide with the longitudinal axis of said connector part.

11. A combination antenna for radio transmission and reception comprising:

a first antenna part (8) and a second antenna part (9, 9*a*, 17), said first antenna part being a straight conductor comprising a whip antenna, a connector part (10) for connecting said first and second antenna parts to a radio apparatus, and a second plane surface which further comprises an electrically conductive area for attenuating in a certain direction radio-frequency radiation emitted by a conductive pattern, characterized in that said second antenna part (9, 9*a*, 17) comprises a first plane surface which further comprises said conductive pattern (17) for transmitting and receiving radio-frequency radiation, while said first and second antenna parts are mechanically coupled to said connector part, said first plane surface is separated from said first antenna part and said first antenna part is between said first and second plane surfaces and extends through said second antenna part, and said second plane surface is included in the second antenna part (9, 17), said second antenna part further comprises:

a cylindrical hole (18) for allowing said first antenna part to pass through it, an electrically conductive coupling area on the inner surface of said hole, and an electrical conductor (19) between said coupling area and the conductive pattern (16, 16*a*, 16*b*) on the first plane surface of said second antenna part.

12. The combination antenna of claim 7, characterized in that said conductive pattern comprises a first end and a second end and said electrical conductor connects said coupling area to a location which is between said first and second ends.

* * * * *

UNITED STATES PATENT AND TRADEMARK OFFICE

CERTIFICATE OF CORRECTION

PATENT NO. : 6,031,496

DATED : February 29, 2000

INVENTOR(S) : Tero KUITTINEN and Petteri ANNAMAA

It is certified that errors appear in the above-identified patent and that said Letters Patent is hereby corrected as shown below:

On the front page, item [73] Assignee, Please correct "IK-Products Oy"

to --LK-Products Oy--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,031,496 
DATED : February 29, 2000
INVENTOR(S) : Tero Kuittinen and Petteri Annamaa It is certified that error appears in the above-identified patent and that said Letters Patent is hereby corrected as shown below:

<u>Title page,</u>
Item [73] Assignee, Please correct "IK-Products Oy" to -- LK-Products Oy --.

Signed and Sealed this

Eighteenth Day of September, 2001

*Attest:*

Nicholas P. Godici

NICHOLAS P. GODICI
*Attesting Officer* *Acting Director of the United States Patent and Trademark Office*